US005845702A

United States Patent [19]

Dinh

[11] Patent Number: 5,845,702

[45] **Date of Patent: *Dec. 8, 1998**

[54] SERPENTINE HEAT PIPE AND DEHUMIDIFICATION APPLICATION IN AIR CONDITIONING SYSTEMS

[75] Inventor: Khanh Dinh, Alachua, Fla.

[73] Assignee: Heat Pipe Technology, Inc., Alachua, Fla.

[ * ] Notice: The term of this patent shall not extend beyond the expiration date of Pat. Nos. 5,404,938 and 5,333,470.

[21] Appl. No.: 906,360

[22] Filed: Jun. 30, 1992

[51] Int. Cl.[6] ..... F28D 15/02

[52] U.S. Cl. ..... 165/104.21; 165/104.14; 165/104.29

[58] Field of Search ..... 165/104.14, 150, 165/104.21, 104.22, 104.29, 104.28; 62/119

[56] References Cited

U.S. PATENT DOCUMENTS

| | | | |
|---|---|---|---|
| 3,143,592 | 8/1964 | August | 165/104.21 X |
| 3,877,518 | 4/1975 | Dreksler | 165/150 |
| 4,091,547 | 5/1978 | Leigh | 165/104.21 X |
| 4,259,268 | 3/1981 | DiRoss | 261/151 |
| 4,333,517 | 6/1982 | Parro | 165/104.21 X |
| 4,452,051 | 6/1984 | Berger et al. | 62/467 |
| 4,607,498 | 8/1986 | Dinh | 62/185 |
| 4,724,901 | 2/1988 | Munekawa | 165/104.21 |
| 4,827,733 | 5/1989 | Dinh | 62/119 |
| 4,921,041 | 5/1990 | Akachi | 165/104.29 |
| 4,971,139 | 11/1990 | Khattar | 165/104.14 X |
| 5,033,539 | 7/1991 | Kohtaka | 165/104.14 |
| 5,333,470 | 8/1994 | Dinh | 165/104.14 X |
| 5,404,938 | 4/1995 | Dinh | 165/104.14 X |

FOREIGN PATENT DOCUMENTS

| | | | |
|---|---|---|---|
| 0 046 716 | 3/1982 | European Pat. Off. . | |
| 2 330 965 | 6/1977 | France . | |
| 2 407 445 | 5/1979 | France . | |
| 2 479 435 | 10/1981 | France . | |
| 11591 | 1/1986 | Japan | 165/104.14 |
| 85346 | 1/1936 | Sweden | 165/104.21 |
| 2 006 950 | 5/1979 | United Kingdom . | |
| 2213920 | 8/1989 | United Kingdom | 165/104.33 |

OTHER PUBLICATIONS

*Patent Abstract of Japan*, vol. 7, No. 74 (M–203) (1219) 26 Mar. 1983 & JP–A–58 002 593 (Hitachi Seisakusho KK) 8 Jan. 1983 (abstract).

*Primary Examiner*—Leonard R. Leo
*Attorney, Agent, or Firm*—Nilles & Nilles

[57] ABSTRACT

A heat pipe heat exchanger is provided in the form of a serpentine heat pipe that does not have the ends of the individual tubes manifolded to one another via a straight pipe or via any other common connector. Instead, it has been discovered that heat pipes connected via U-bends to form a continuous coil function adequately. The serpentine heat pipe may include integral condenser and evaporator portions separated by a divider to form a one-slab heat exchanger, or separate evaporator and condenser coils connected to one another by vapor and return lines to form a two-section heat pipe. A method of producing a serpentine heat pipe includes providing a plurality of U-shaped tubes which are interconnected to form a single serpentine heat pipe, one of the tubes having an open end, and inserting sufficient refrigerant in the one tube to allow each of the tubes to function as a separate heat pipe. The serpentine heat pipe heat exchanger may be used to increase the dehumidification capacity of an air conditioner.

7 Claims, 6 Drawing Sheets

SERPENTINE HEAT PIPE AND DEHUMIDIFICATION APPLICATION IN AIR CONDITIONING SYSTEMS

BACKGROUND OF THE INVENTION

The present invention relates to passive heat transfer devices and more particularly relates to heat pipes utilizing the high latent heat of evaporation and condensation, together with the phenomenon of capillary pumping of a wick, to transfer very high heat fluxes without the addition of external energy.

So-called heat pipes are well known, and typically comprise a condenser and an evaporator connected to one another as a closed system. Referring to FIG. 1, the typical heat pipe 6 comprises an enclosed tube 8 having one end forming an evaporator portion 10 and having another, somewhat-cooler and lower-pressure end forming a condenser portion 12. A wick 14 extends through the heat pipe from the evaporator portion 10 to the condenser portion 12. The surrounding environment is cooled by the evaporator portion and reheated by the condenser portion with the help of fins 15.

In use, liquid refrigerant 11 present in the evaporator portion 10 is heated by the environment, vaporized, and rises into the condenser portion 12. In the condenser portion 12, the refrigerant is cooled by the environment, is condensed with the release of latent heat, and is then pumped back to the evaporator portion 10 by the action of the capillary structure of the material forming the wick 14. The cycle then repeats itself, resulting in a continuous cycle in which heat is absorbed from the environment by the evaporator and released by the condenser.

As illustrated in FIG. 2, it is also known to increase the capacity of heat pipes by incorporating several individual heat pipes 20 in a single assembly 21. Each individual heat pipe is constructed and operable as the heat pipe illustrated in FIG. 1. While such an assembly has a significantly higher capacity than a single heat pipe, it is difficult and expensive to fabricate since each pipe must be individually charged with the proper amount of refrigerant.

Referring now to FIGS. 3A and 6A, it has been proposed to reduce the fabrication and installation costs of heat pipes by utilizing U-shaped heat pipes connected to form serpentine heat pipes. Fabrication costs are decreased through the use of the U-shaped tubes. However, it was thought that the individual tubes of such heat pipes could not be charged with refrigerant and that the serpentine coils would inhibit fluid movement through the heat pipes, thus decreasing their efficiency. One way that such serpentine heat exchangers are rendered useful as heat pipes is to vertically orient a heat exchanger such that the tops of individual coils act as condensers and the bottoms act as evaporators. The individual coils are manifolded together to provide what were thought to be the interconnections required to enable charging of the individual heat pipes. Thus, referring to FIG. 3A, the ends of the individual U-tubes 30A of a heat pipe are manifolded in such a way that the liquid refrigerant can move freely from tube to tube, thus assuring that the liquid level 34A is the same in all tubes. More specifically, the bottoms 35A of the U tubes 30A are pierced and small copper tubes 36A are soldered to the perforations to interconnect the U tubes at their lower ends. The open ends of the adjacent U tubes are manifolded to one another by a straight pipe 37A. The resulting connection allows unrestricted communication between the ends of adjacent tubes and assures that the liquid level is the same in all tubes. Microgrooves 33 are formed in each tube 30A, and the individual tubes are imbedded in aluminum fins 32 to form a heat pipe heat exchanger.

In another configuration utilizing serpentine heat exchangers, two horizontal heat exchangers may be connected to one another such that the lower of the two horizontal serpentine heat exchangers acts as an evaporator and the higher one acts as a condenser. Referring to FIG. 6A, it was thought necessary to manifold the U tubes 60A of the lower section by a first copper tube 63A and to manifold the U tubes 61A of the upper section in the same manner by a second copper tube 64A. The upper ends of these manifolded tubes are connected by a first copper connection tube 62A which serves as a vapor line, while the lower ends of these tubes are connected by a second copper connection tube 65A serving as a return line.

Each of the devices illustrated in FIGS. 3A and 6A works well. However, both devices are expensive to fabricate and to install, thus rendering them unsuitable for many applications.

It is also known to use heat pipes to increase the dehumidification capacity or efficiency of an air conditioning system. One such system is described in U.S. Pat. No. 4,607,498, which issued to Khanh Dinh on Aug. 26, 1986. Referring to FIG. 13, this type of air conditioning system 110 includes a primary evaporator 124 and a heat pipe heat exchanger 126 which is provided to increase the dehumidification capacity of the system during cool and humid hours. This heat pipe consists of a pair of manifolded heat exchangers of the type illustrated in FIG. 6A. A first heat exchanger 128 serves as an evaporator and is located between an inlet of the air conditioner and the primary coil 124. A second manifolded heat exchanger 130 is located between the primary evaporator 124 and the outlet of the housing and serves as a condenser of the heat pipe. The heat sections 128 and 130 are interconnected by a vapor line 134 and a return line 140.

The heat pipe heat exchanger 126 operates as follows:

Warm air enters the housing from the inlet and is cooled slightly as it passes over evaporator 128, thereby vaporizing the liquified refrigerant present in the evaporator. The air then passes over the primary evaporator 124, where it is cooled further. Meanwhile, the vaporized refrigerant rises out of the header of the evaporator 128, through conduit 134, and into the header of condenser 130. The refrigerant in the condenser 130 is cooled by air exiting the primary evaporator 124 so that it is liquefied while simultaneously reheating the air. The liquified refrigerant then flows downwardly into the inlet of evaporator 128 via conduit 140, and the process is repeated.

While the heat pipes described above significantly improve the efficiency of air conditioners, the manifolded heat pipes require additional machining of the serpentine coils and require that headers be connected to the ends of the coils. Accordingly, they are relatively difficult and expensive to fabricate. Thus, the cost of such heat pipes may render impractical their use in many applications, including many conventional air conditioning systems.

OBJECTS AND SUMMARY OF THE INVENTION

An object of the invention is to provide a serpentine heat pipe which is inexpensive to fabricate and which can be easily charged with refrigerant.

In accordance with a first aspect of the invention, this object is achieved by providing a serpentine heat pipe having a plurality of U-shaped tubes having adjacent open ends and a plurality of U-shaped connectors interconnecting the adjacent open ends to form a single serpentine heat pipe. The tubes are partially filled with a refrigerant.

Further in accordance with this aspect of the invention, fins interconnect the U-shaped tubes, thereby forming a serpentine heat pipe heat exchanger. The serpentine heat exchanger may include integral condenser and evaporator portions separated by a divider to form a one-slab heat exchanger, or separate evaporator and condenser coils connected to one another by vapor and return lines to form a two-section heat pipe.

Another object of the invention is to provide a method of easily and inexpensively producing a serpentine heat pipe.

In accordance with this aspect of the invention, the method includes the steps of providing a plurality of U-shaped tubes which are interconnected to form a single serpentine heat pipe, one of the tubes having an open end, and inserting sufficient refrigerant in the one tube to allow each of the tubes to function as a separate heat pipe.

Further in accordance with this aspect of the invention, the providing step may comprise providing a plurality of adjacent U-shaped tubes having adjacent open ends, and manifolding together the adjacent open ends via U-shaped connectors.

Still another object of the invention is to provide a method of economically increasing the dehumidification capacity of the primary evaporator of an air conditioner.

In accordance with this aspect of the invention, the method comprises pre-cooling and dehumidifying air via an evaporator portion of a serpentine heat exchanger comprising at least one serpentine heat pipe, then cooling the air via a primary evaporator, and then reheating the air via a condenser portion of the heat pipe heat exchanger.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like reference numerals represent like parts throughout, and in which.

DETAILED DESCRIPTION OF THE PREFERRED EMBODIMENTS

Pursuant to the invention, a heat pipe heat exchanger is provided in the form of a serpentine heat pipe that does not have the ends of the individual tubes manifolded to one another via a straight pipe or via any other common connector. Instead, it has been discovered that heat pipes connected via U-bends to form a continuous coil function adequately.

Figure 1:
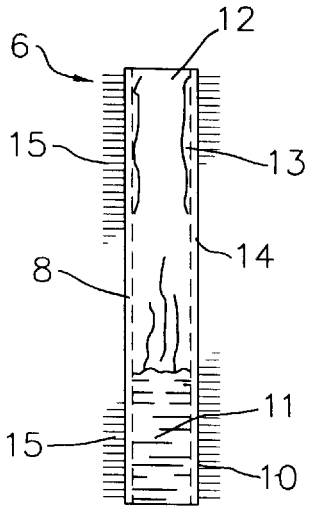
FIG. 1 PRIOR ART
FIG. 1 is a schematic sectional side view of a conventional heat pipe.
Figure 2:
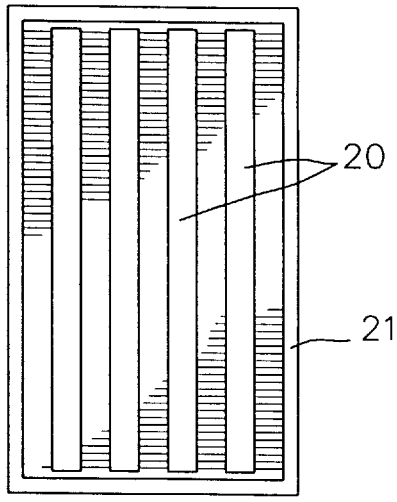
FIG. 2 PRIOR ART
FIG. 2 is a schematic sectional side view of a conventional heat pipe heat exchanger having multiple independent heat pipes.
Figure 3:
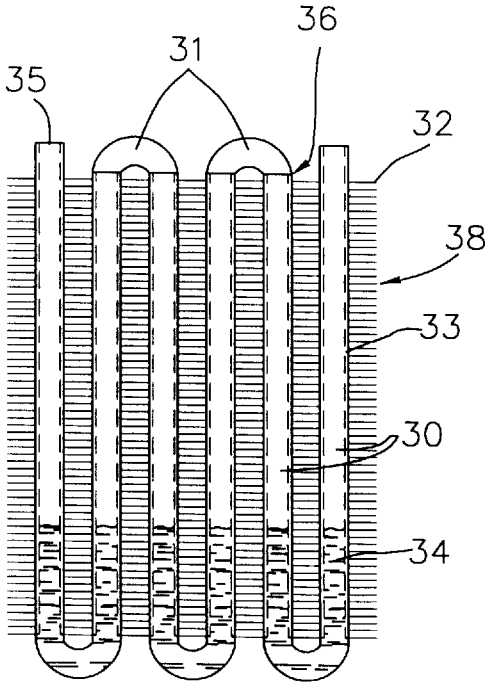
FIG. 3A is a sectional schematic elevation view of a conventional serpentine heat pipe.
FIG. 3B is a sectional schematic elevation view of a serpentine heat pipe constructed in accordance with a first embodiment of the invention.
Figure 3A:
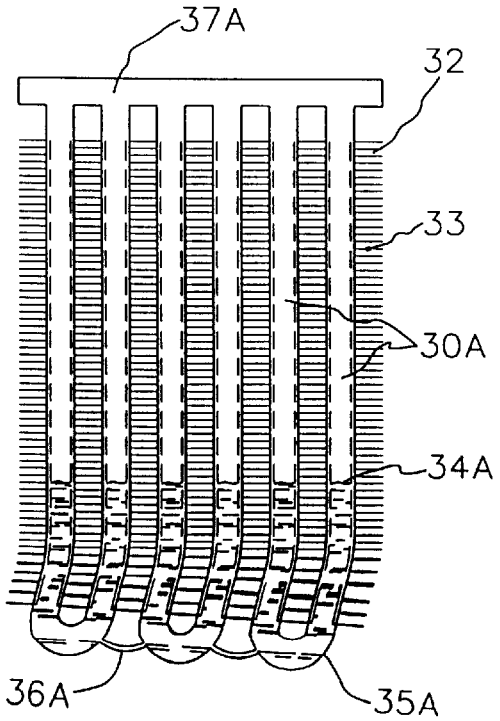
FIG. 3A PRIOR ART

Referring to FIG. 3A, a heat pipe heat exchanger 38, constructed in accordance with the present invention, includes a plurality of U-shaped tubes 30 which are manifolded to one another via U-bends 31 which interconnect the open ends of the adjacent tubes 30, thereby forming a serpentine heat pipe 36. The heat pipe is embedded in heat conducting fins 32, preferably formed from aluminum, thus forming the serpentine heat pipe heat exchanger 38. The individual tubes 30 do not contain a wick, but instead have microgrooves 33 formed on their internal walls for higher heat transfer.

To prepare the heat pipe heat exchanger 38 of FIG. 3 for use, a predetermined amount of refrigerant 34 is inserted into the open end of an edge tube 35 of the serpentine heat pipe 36. Enough refrigerant should be inserted so that, in steady state operating conditions, sufficient refrigerant will be present in each tube 30 to allow each tube to function adequately as a separate heat pipe. Heretofore, it was thought that such fluid levels could be obtained in the individual tubes only by manifolding the individual tubes together as described above in connection with FIGS. 3A and 6A. However, it has been discovered that no such manifolding is necessary and that, if the fluid is inserted in the edge tube of a serpentine heat pipe of the type illustrated in FIG. 3A, the fluid will be evenly distributed in the tubes as illustrated in FIG. 3A after only a few minutes of normal operation of the device. Accordingly, it has been found that the connection tubes and straight pipe manifolds of previous serpentine heat pipes are not required.

Figure 4:
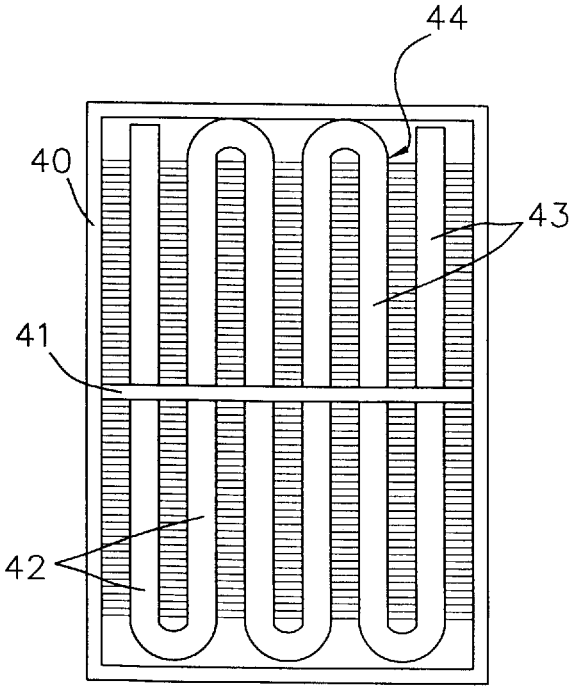
FIG. 4 is a schematic sectional side view of a one-slab serpentine heat pipe heat exchanger constructed in accordance with the invention.

Referring now to FIG. 4, the serpentine heat pipe discussed above can be used in a one-slab heat pipe heat exchanger 40 having a central divider 41 thermally separating the upper and lower portions forming evaporator and condenser portions of the individual tubes of a heat pipe 44. In use, warm air is conveyed through the lower section of the serpentine heat exchanger, thus vaporizing the fluid in the lower portions 42 of the individual tubes and cooling the air. The vaporized fluid rises into the upper section of the heat exchanger where it is condensed in the upper portions 43 of the tubes via relatively cool air flowing through that section of the heat pipe heat exchanger. The thus condensed liquid then flows back into the lower portions 42 of the tubes via the microgrooves formed in the tubes, and the process begins anew.

Figure 5:
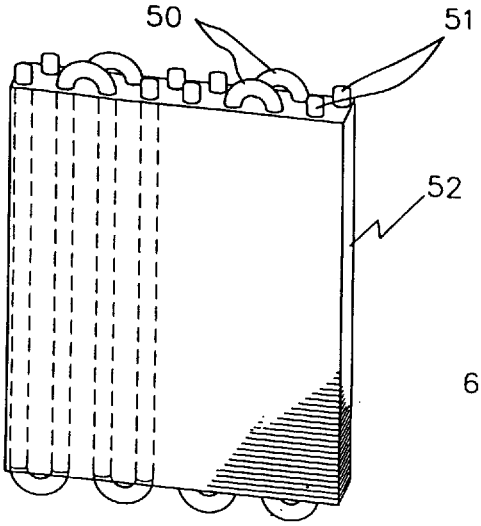
FIG. 5 is a perspective view of a one-slab heat pipe heat exchanger having several rows of serpentine heat pipes.

As illustrated in FIG. 5, several serpentine heat pipes 50 of the type illustrated in FIGS. 3 and 4 can be stacked in several rows 51 to form a one-slab heat pipe heat exchanger 52, thus increasing the cooling and heating capacities of the evaporator and condenser portions of the heat exchanger.

Figure 6A:
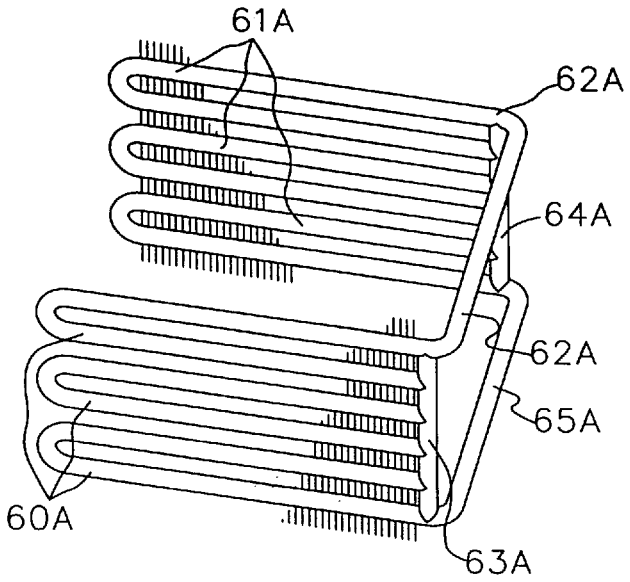
FIG. 6A PRIOR ART
FIG. 6A is a perspective view of a conventional two-section heat pipe heat exchanger.
Figure 7:
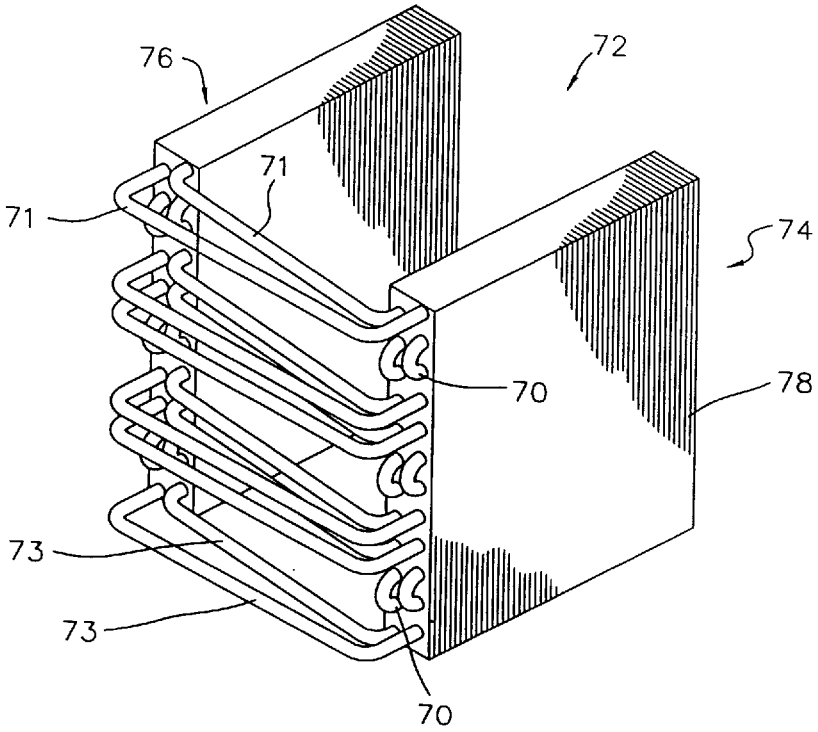
FIG. 7 is a perspective view of a two-section heat pipe heat exchanger constructed in accordance with the invention having multiple rows of stacked two-section heat pipes.

Turning now to FIG. 6A, a serpentine heat pipe 64 can also be designed as two separate sections. The heat pipe according to this embodiment of the invention includes serpentine coils 60, 61 forming a lower serpentine section 65 which functions as an evaporator, and a higher serpentine section 66 which functions as a condenser. As in the previous embodiment, each of the serpentine coils 60, 61 includes a plurality of U-tubes having the adjacent open ends manifolded together by U-bends 67 instead of one straight copper tube. Again, it has been discovered that this configuration works equally as well as the manifolded device illustrated in FIG. 6A, but is significantly less expensive and easier to fabricate. The two serpentine sections 65, 66 are connected to one another via a vapor line 62 and a return line 63, thereby forming the two-section heat pipe 64. If desired, several two-section heat pipes 70 can be stacked on top of one another and connected by vapor and return lines 71, 73 as illustrated in FIG. 7 to form a single heat pipe heat exchanger 72 having an evaporator section 74 and a condenser section 76, each of which includes a plurality of serpentine coils. As in the embodiments of FIGS. 3–5, each section of the heat pipe heat exchanger is imbedded in aluminum fins 78 to promote heat transfer.

These inventive heat pipes and heat pipe heat exchangers can be used to increase the dehumidification capacity of conventional air conditioning systems. More particularly, the evaporator portion of a serpentine heat pipe heat exchanger can be positioned upstream of the primary evaporator of an air conditioner to precool and dehumidify the air flowing through the system, and the condenser portion can be positioned downstream of the primary evaporator to reheat the overcooled air.

Figure 8:
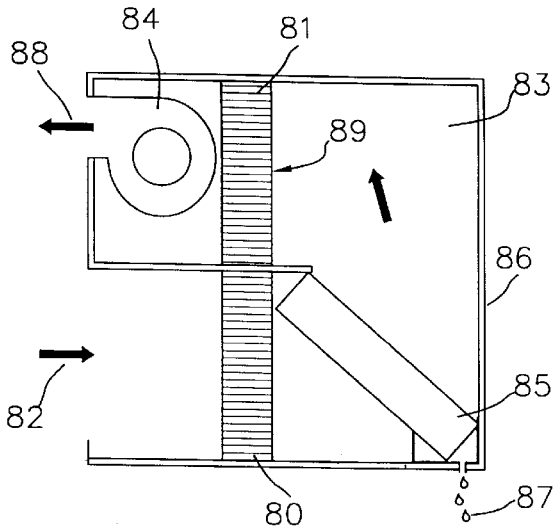
FIG. 8 illustrates a method of installing a serpentine heat pipe heat exchanger in an air conditioning system.

Referring to FIG. 8, a serpentine heat pipe heat exchanger 89 can be installed in a conventional air conditioning system by placing the evaporator portion 80 of a serpentine heat pipe of the heat exchanger 89 in the warm return air path 82 leading to the primary evaporator 85 of the air conditioner and by placing the condenser portion 81 downstream of the primary evaporator 85 in the cool air supply path 88. This positioning allows the refrigerant to vaporize in the evaporator portion 80 and to rise to the condenser portion 81. There, cool air being drawn off from the primary evaporator 85 via a blower 84 is reheated in condenser portion 81, where it condenses the refrigerant in condenser portion 81 before it is discharged from the air conditioner.

Refrigerant vaporizing in the evaporator portion 80 absorbs the heat from return air 82 and precools this air before the air reaches the primary evaporator 85. This precooling allows the primary evaporator 85 to work cooler and thus to condense more moisture, which is discharged from the evaporator as a condensate 87. The vaporized refrigerant in the heat pipe of the serpentine heat exchanger 89 rises to the condenser portion 81, condenses, and releases heat into the supply air 88.

This arrangement provides cool air with lower relative humidity. Demand for such cool, dry air is very high in humid climates and in certain industrial and commercial applications. Precooling and reheating the air in an air conditioner has numerous beneficial results and can save great amounts of energy. For example, by precooling the return air 82, the serpentine heat pipe heat exchanger 89 reduces the cooling load on the compressor of the air conditioner. In addition, by providing dry air, the system reduces humidity and provides better comfort at higher thermostat temperature settings. Finally, by providing free reheating energy, the system replaces the reheat systems currently used in humidity control systems, thus saving substantial energy which would otherwise be consumed by such reheat systems.

Figure 9:
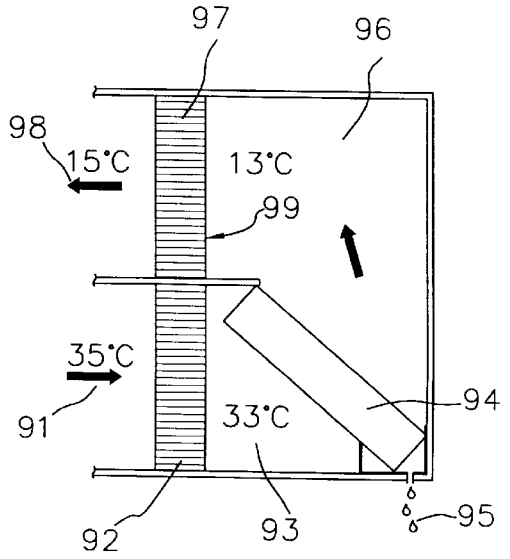
FIG. 9 illustrates the manner of operation of the heat pipe heat exchanger of FIG. 8 in conjunction with an air conditioning system.

The working principles of the serpentine heat pipe heat exchanger in an air conditioning system will now be disclosed with reference to FIG. 9. In the typical case, warm return air 91 at a temperature of, e.g., 35° C. enters the air conditioner and is conveyed through the evaporator portion 92 of a serpentine heat pipe of a serpentine heat pipe heat exchanger 99 and transfers heat to the refrigerant in the heat pipe, thus vaporizing the refrigerant. This heat transfer precools the air exiting the evaporator portion 92 to a somewhat lower temperature of, e.g., 33° C. This cooler air is then dehumidified and cooled in the primary evaporator 94 to a temperature of, e.g., 13° C. The moisture condensing in primary evaporator 94 drains out of the system as a condensate 95. The now overcooled air 96 is then conveyed through the condenser portion 97 of the heat pipe and is slightly reheated to a comfortable temperature of, e.g., 15° C. This heat transfer condenses the refrigerant in the condenser portion 97, and the condensed refrigerant drains back into evaporator portion 92. The thus reheated air 98 is then conveyed out of the air conditioner.

Figure 6:
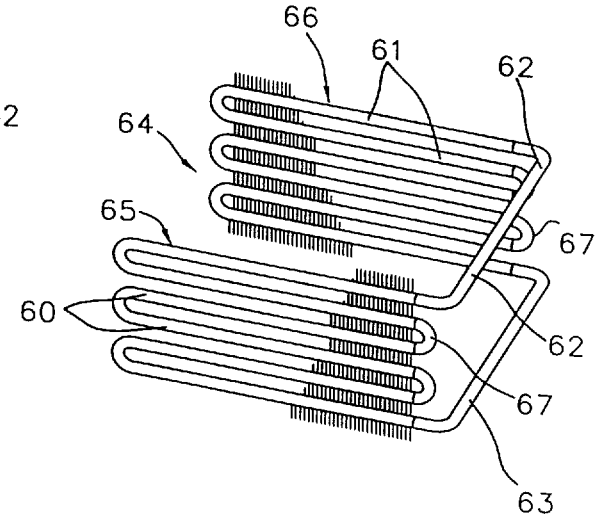
FIG. 6B is a perspective view of a two-section heat pipe heat exchanger constructed in accordance with another embodiment of the invention.

This method of using serpentine heat pipes to precool the return air and to reheat the supply air in an air conditioning system can be applied to both the one-slab design of a heat pipe heat exchanger illustrated in FIGS. 3–5 and to the two-section design illustrated in FIGS. 6 and 7. Moreover, there are several ways of positioning the serpentine heat exchangers in air conditioners. Some possible configurations of such serpentine heat exchangers are illustrated in FIGS. 8–12 with FIGS. 8, 9, and 10 illustrating a one-slab design and FIGS. 11 and 12 illustrating a two-section design.

Figure 10:
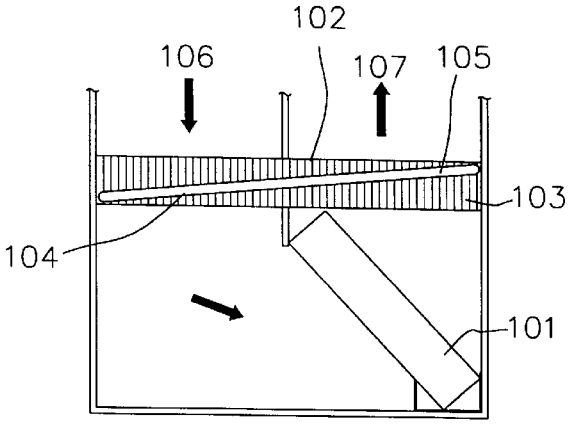
FIG. 10 illustrates another configuration of a heat pipe heat exchanger in an air conditioning system.

One-slab heat exchangers can be positioned in an air conditioning system either vertically as described above in connection with FIGS. 8 and 9, or horizontally, as illustrated in FIG. 10. In FIG. 10, the one-slab heat exchanger 102 is positioned horizontally, but the individual serpentine heat pipes within the slab are inclined with their lower or evaporator portions 104 in the warm return air path 106 and their higher or condenser portions 105 in the cold supply air path 107. Fins 103 promote heat transfer in the heat exchanger 102. The operation of this device is identical to that disclosed above with respect to FIGS. 8 and 9.

Figure 11:
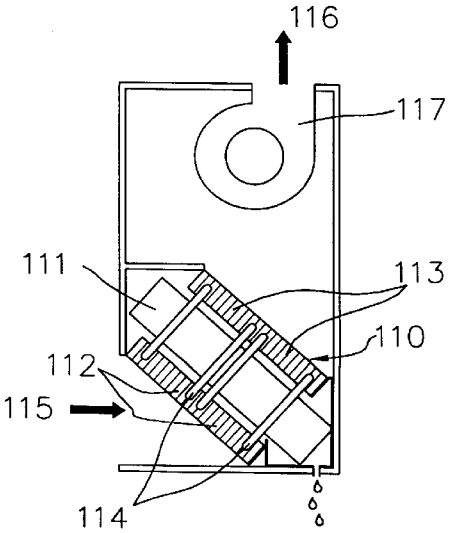
FIG. 11 illustrates still another configuration of a heat pipe heat exchanger in an air conditioning system.

Referring to FIG. 11, a two-section serpentine heat pipe heat exchanger 110 can also be positioned in an air conditioner in an inclined position. In this embodiment, return air 115 is drawn into the system via a blower 117. The lower or evaporator section 112 of each heat pipe of the heat exchanger 110 is placed in the path of the warm return air 115 leading to the air conditioner evaporator 111. The higher or condenser section 113 of each heat pipe of the heat exchanger 110 is positioned downstream of the evaporator 111 in the path 116 of cold supply air. Each of the sections 112, 113 may comprise several rows of stacked serpentine coils of the types illustrated in FIGS. 6 and 7. The lower and upper coils of each two-section heat pipe are connected by connection lines 114 composed of vapor and return lines connecting the upper and lower ends of the respective coils.

Figure 12:
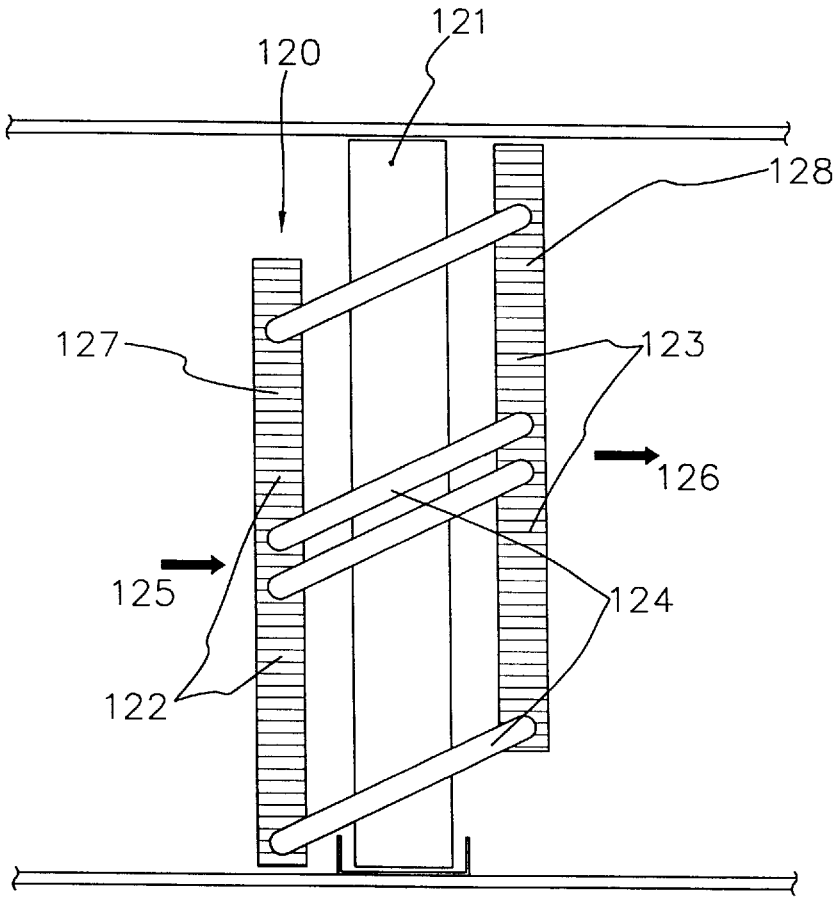
FIG. 12 illustrates yet another configuration of a heat pipe heat exchanger in an air conditioning system.
Figure 13:
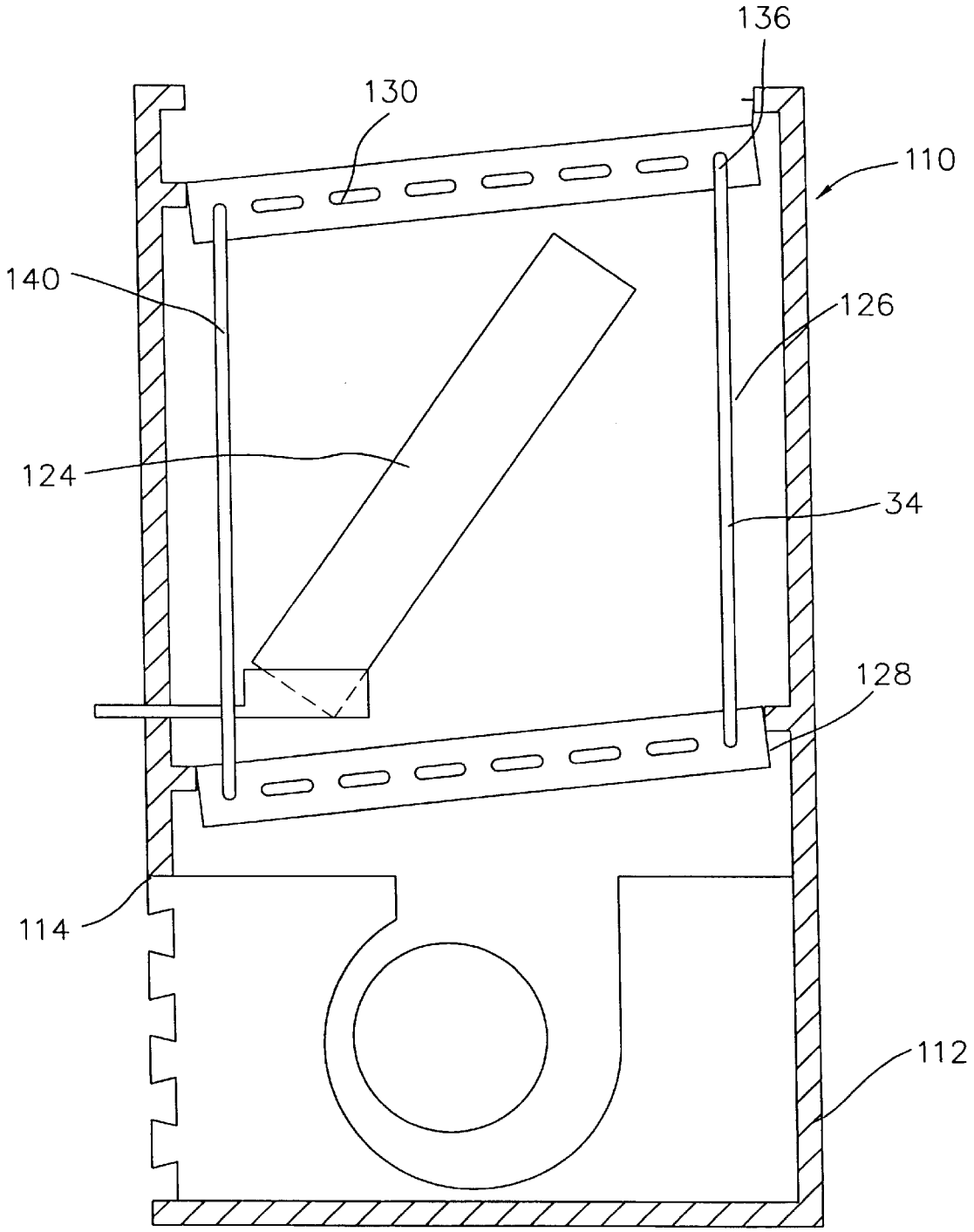
FIG. 13 PRIOR ART
FIG. 13 illustrates a conventional configuration of a heat pipe heat exchanger in an air conditioning system.

Referring to FIG. 12, an inventive two-section heat pipe heat exchanger 120 of the type described above in connection with FIGS. 6 and 7 can also be used when an air conditioner evaporator 121 is in a vertical position. According to this embodiment of the invention, the evaporator section 127 of the heat exchanger 120 contains the low or evaporator sections 122 of the individual two-section serpentine heat pipes stacked one on top of the other upstream of the primary evaporator 121 in the path 125 of warm return air. A condenser section 128 of the two-section heat exchanger 120 contains the high or condenser sections 123 of the two-section serpentine heat pipes and is placed in the path 126 of cold supply air. The serpentine coils comprising the low and high sections of each of the heat pipes are connected by connection lines 124. As in the previous embodiments, refrigerant is pre-cooled by the evaporator section 127 and is reheated by the condenser section 128, thus enhancing the dehumidification capacity of the system.

Of course, the serpentine heat pipe heat exchanger of the present invention need not be positioned in an air conditioning system in any of the configurations illustrated above. It is only necessary to design the system such that the evaporator portion or section of one or more serpentine heat pipes functions to precool return air before it is cooled by the primary evaporator of the air conditioning system, and such that the condenser portion or section functions to reheat the supply air after it is cooled by the primary evaporator.

What is claimed is:

1. A method of dehumidifying air comprising the steps of:

pre-cooling and dehumidifying air by passing air through an evaporator section of a device comprising first and second serpentine heat pipe sections configured as continuous coils, a vapor line and a liquid return line connecting the first and second serpentine heat pipe sections to form a single continuous coil two-section heat pipe having a generally U-shaped configuration with the first and second serpentine heat pipe sections on respective sides of the U-shape, the first and second serpentine heat pipe sections each including a plurality of U-shaped tubes, the plurality of U-shaped tubes of the first serpentine heat pipe section having a first plane passing therethrough which is substantially parallel to a second plane which passes through the plurality of U-shaped tubes of the second serpentine heat pipe section, a height of the second serpentine heat pipe section being approximately equal to a height of the first serpentine heat pipe section, the height of the first serpentine heat pipe section being defined by a distance between two edge tubes of the first serpentine heat pipe section and the height of the second serpentine heat pipe section being defined by a distance between two edge tubes of the second serpentine heat pipe section, the first and second serpentine heat pipe sections and a cooling coil being horizontally aligned in side-by-side-by-side fashion with the cooling coil being disposed in between the first and second serpentine heat pipe sections, the single continuous coil two-section heat pipe being partially filled with a refrigerant which passively circulates through the single continuous coil two-section heat pipe in a continuous cycle and in a self-pumping manner without the aid of a separate pump, the first serpentine heat pipe section forming the evaporator section of the two-section heat pipe and the second serpentine heat pipe section forming a condenser section of said two-section heat pipe; then cooling said air via the cooling coil; and then reheating said air via the condenser section of said device.

2. An apparatus comprising:

a cooling coil, and a single continuous coil two-section heat pipe having a generally U-shaped configuration, said single continuous coil two-section heat pipe including first and second serpentine heat pipe sections each configured as a continuous coil, and a vapor line and a liquid return line which connect said first serpentine heat pipe section to said second serpentine heat pipe section thereby forming said single continuous coil two-section heat pipe with said generally U-shaped configuration with said first serpentine heat pipe section and said second serpentine heat pipe section on respective sides of said U-shape, wherein said first and second serpentine heat pipe sections each include a plurality of U-shaped tubes, wherein said single continuous coil two-section heat pipe is partially filled with a refrigerant which passively circulates through the single continuous coil two-section heat pipe in a self-pumping manner and without the aid of a separate pump, and said first serpentine heat pipe section forms an evaporator section of said two-section heat pipe and said second serpentine heat pipe section forms a condenser section of the two-section heat pipe, wherein said first and second serpentine heat pipe sections, said vapor line, and said liquid return line are constructed and arranged such that, in operation, said first and second serpentine heat pipe sections and said cooling coil are horizontally aligned in side-by-side-by-side fashion with said cooling coil being disposed in between said first and second serpentine heat pipe sections.

3. The device according to claim 2, further comprising at least one two-section serpentine heat pipe stacked on top of said two-section heat pipe, and heat conducting fins interconnecting said two-section heat pipes to form a heat pipe heat exchanger.

4. The device according to claim 2, further comprising an air conditioner having said cooling coil as a primary evaporator, and wherein said evaporator section of said two-section heat pipe is located upstream of said primary evaporator and said condenser section of said two-section heat pipe is located downstream of said primary evaporator.

5. A device according to claim 2, further comprising heat conducting fins which interconnect the plurality of U-shaped tubes of at least one of the first and second serpentine heat pipe sections.

6. A device according to claim 2, wherein said vapor line and said liquid return line are parallel.

7. A device for improving the dehumidification capability of an air conditioner, comprising:

a primary evaporator having a base, a side surface substantially perpendicular to said base, and an operative surface substantially perpendicular to said base, said base having a bottom surface parallel to a ground plane;

a single continuous coil U-shaped two-section heat pipe heat exchanger including a refrigerant which passively circulates through said U-shaped two-section heat pipe heat exchanger in a continuous cycle and in a self-pumping manner without the aid of a separate pump, a first serpentine section disposed opposing a first side of said operative surface and arranged substantially parallel therewith, said first serpentine section forming an evaporator section of said U-shaped two-section heat pipe heat exchanger, a second serpentine section disposed opposing a second side of said operative surface and arranged substantially parallel therewith, said second serpentine heat pipe section forming a condenser section of said U-shaped two-section heat pipe heat exchanger, a vapor line connecting said first serpentine section to said second serpentine section, said vapor line located adjacent said side surface, said vapor line being parallel to a bottom surface of said base, and said vapor line having a linear section with a length less than a height of said at least one side surface, and a liquid return line connecting said first serpentine section to said second serpentine section, said liquid return line located adjacent said side surface, said vapor line and said liquid return line being parallel to a bottom surface of said base, and said liquid return line having a linear section with a length less than said height of said at least one side surface; and a housing surrounding said primary evaporator and said U-shaped two-section heat pipe heat exchanger so that said refrigerant cycles passively between said evaporator section and said condenser section when an air stream passes through said housing;

wherein said first and second serpentine heat pipe sections each include a plurality of U-shaped tubes, wherein a first plane which passes through said plurality of U-shaped tubes of said first serpentine heat pipe section is parallel to a second plane which passes through said plurality of U-shaped tubes of said second serpentine heat pipe section, wherein a height of said second serpentine heat pipe section is approximately equal to a height of said first serpentine heat pipe section, said height of said first serpentine heat pipe section being defined by a distance between two edge tubes of said first serpentine heat pipe section and said height of said second serpentine heat pipe section being defined by a distance between two edge tubes of said second serpentine heat pipe section, wherein said primary evaporator is disposed between said first serpentine section and said second serpentine section.

* * * * *